US005815857A

United States Patent [19]

De Lorenzo

[11] Patent Number: 5,815,857

[45] Date of Patent: Oct. 6, 1998

[54] SOFA-BED

[75] Inventor: Stelio De Lorenzo, Milan, Italy

[73] Assignee: Lampolet S.p.A., Italy

[21] Appl. No.: 829,950

[22] Filed: Apr. 1, 1997

[30] Foreign Application Priority Data

Apr. 17, 1996 [IT] Italy ..... MI96A0735

[51] Int. Cl.[6] ..... A47C 17/22; A47C 17/04

[52] U.S. Cl. ..... 5/13; 5/29

[58] Field of Search ..... 5/13, 28, 29

[56] References Cited

U.S. PATENT DOCUMENTS

| | | | |
|---|---|---|---|
| 1,543,103 | 6/1925 | Heale | 5/13 |
| 4,905,328 | 3/1990 | Pokorny | 5/13 |

FOREIGN PATENT DOCUMENTS

| | | | |
|---|---|---|---|
| 323809 A1 | 7/1989 | European Pat. Off. | 5/13 |
| 0628269 | 12/1994 | European Pat. Off. | 5/13 |
| 628269A1 | 12/1994 | European Pat. Off. | 5/13 |
| 386433 | 1/1933 | United Kingdom . | |
| 2239170 | 6/1991 | United Kingdom | 5/13 |

*Primary Examiner*—Alexander Grosz

*Attorney, Agent, or Firm*—Laff, Whitesel, Conte & Saret, Ltd.

[57] ABSTRACT

A sofa-bed (1) is disclosed which comprises a fixed carrying structure (2), at least three movable frames (6, 7, 8) in engagement with each other in a consecutive rotatable manner and shiftable between a closed position and an open position, a kinematic driving mechanism (10) operatively interposed at least between each movable frame and the consecutive one of each said movable frame and synchronization means adapted to move all the movable frames (6, 7, 8) by a single operation from the closed position to the open position and vice versa.

11 Claims, 8 Drawing Sheets

SOFA-BED

FIELD AND BACKGROUND OF THE INVENTION

The present invention relates to a sofa-bed of the type comprising a fixed carrying structure internally defining at least one housing space and comprising at least one rear vertical frame disposed externally of a set of vertically-extending cushions forming the sofa back, and at least three main movable frames consecutively and rotatably in engagement with each other, said movable frames being shiftable in a rotatory-translator movement between a closed position, in which they are folded upon each other and substantially disposed within said housing space, and an open or unfolded position in which the movable frames are consecutively aligned with each other at the outside of said housing space to define a resting plane.

It is known that sofa-beds comprise a fixed carrying structure having a parallelepiped conformation, formed of several fixed frames. More in detail the fixed carrying structure usually presents a rear vertical frame disposed externally of the vertical set of cushions forming the sofa back.

The fixed carrying structure also defines a housing space which, in a condition corresponding to a sofa configuration, is arranged to receive the movable frames which are folded upon each other in a closed position and are generally adapted, in turn, to hold a mattress folded up in several parts.

The movable frames are shiftable from said closed position to an open position corresponding to the condition in which said frames are consecutively and horizontally aligned, by means of one or more kinematic driving mechanisms interposed between the carrying structure and the frames themselves.

In known sofa-beds or chair-beds above all if provided with three or more movable frames, the frame closing and opening operations involve execution of two or more distinct work steps. In other words, the known art obliges the user to intervene in succession on different portions of the sofa-bed so as to carry out the operating steps connected with a change of configuration thereof, in the provided sequence. Practically, these work steps performed on the sofa-bed are sometimes rather complicated and difficult because repetition of several operations in the prescribed order is required. If the prescribed ordered is modified, opening or closing of the sofa-bed in inhibited.

In addition to the above, sofa-beds of known types not only require the set of horizontal cushions to be removed before carrying out the opening operation, in order to enable the movable frames to come out of the fixed carrying structure, but they also do not allow a complete use of the whole horizontal depth of the fixed carrying structure. The is due to the fact that, since the vertical set of cushions is usually integral with the rear vertical frame of said structure. So the head of the first movable frame can only start at a forward position with respect to the vertical set of cushions. In conclusion, a sofa-bed of known type is of greater bulkiness in a longitudinal direction than a traditional bed, the useful length of its resting plane being the same, at least by one portion corresponding to the thickness of the vertical set of cushions. As a result, use of same is not very comfortable in rooms or premises where the available space is very reduced.

SUMMARY OF THE INVENTION

Under this situation, the technical task underlying the present invention is to devise a sofa-bed capable of substantially obviating the above mentioned drawbacks.

Within the scope of this technical task it is an important aim of the invention to provide a sofa-bed enabling user's interventions in the opening and closing operations of the sofa-bed itself to be facilitated and simplified to a maximum extent.

Another important aim of the invention is to provide a sofa-bed in which the resting plane takes up the whole depth of the fixed carrying structure in a horizontal direction when the sofa-bed itself is opened to a bed configuration.

The technical task mentioned and the aims specified are substantially achieved by a sofa-bed of the type described in the claims.

BRIEF DESCRIPTION OF THE DRAWINGS

The description of two preferred non-exclusive embodiments of a sofa-bed in accordance with the invention are given hereinafter by way of non-limiting examples with reference to the accompanying drawings, in which:

FIG. 6 is a plan view of the sofa-bed in an open condition; an

DESCRIPTION OF THE PREFERRED EMBODIMENTS

Figure 1:
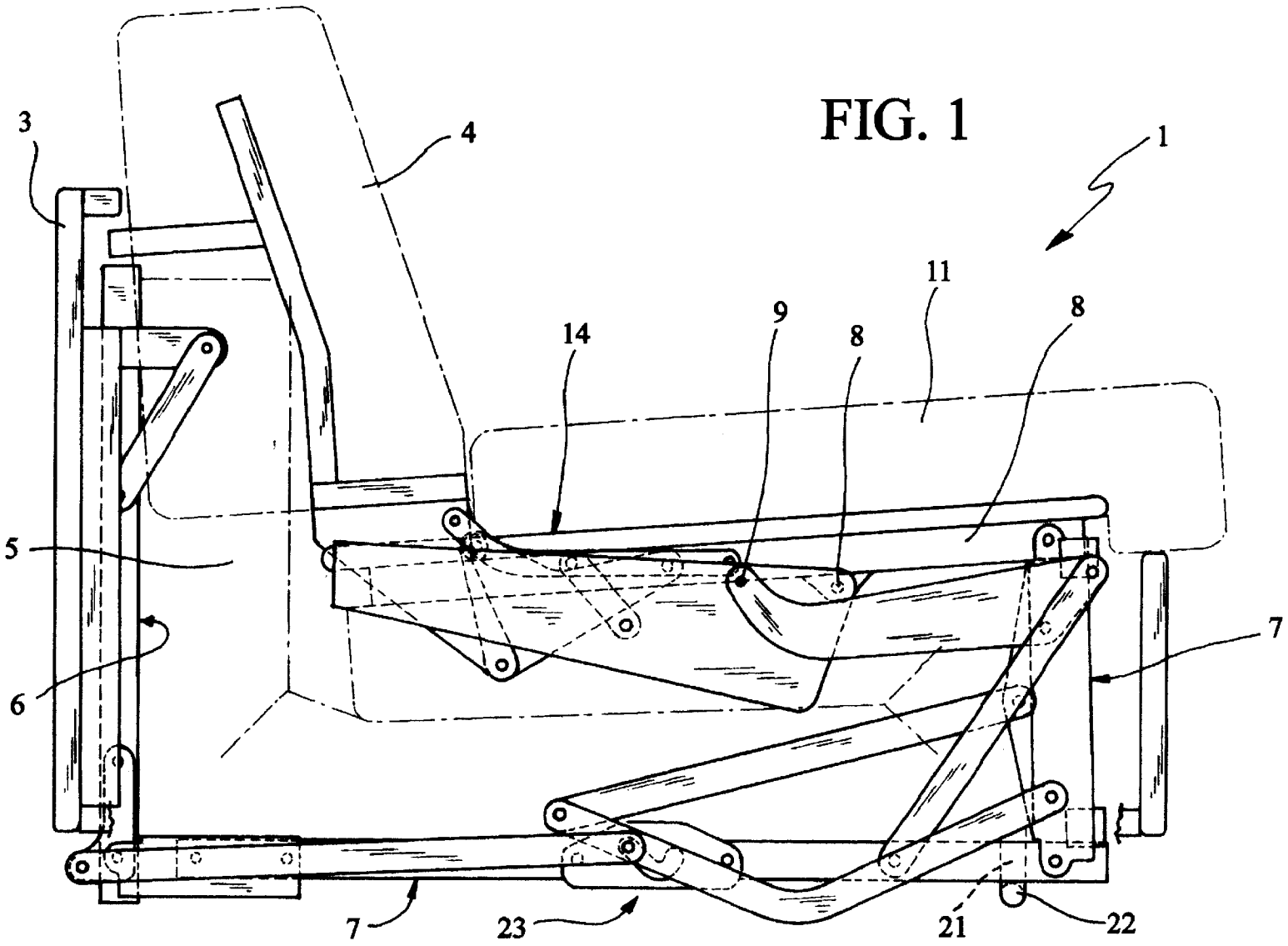
FIG. 1 is a side view of the sofa-bed being the object of the present invention in a sofa condition.
Figure 2:
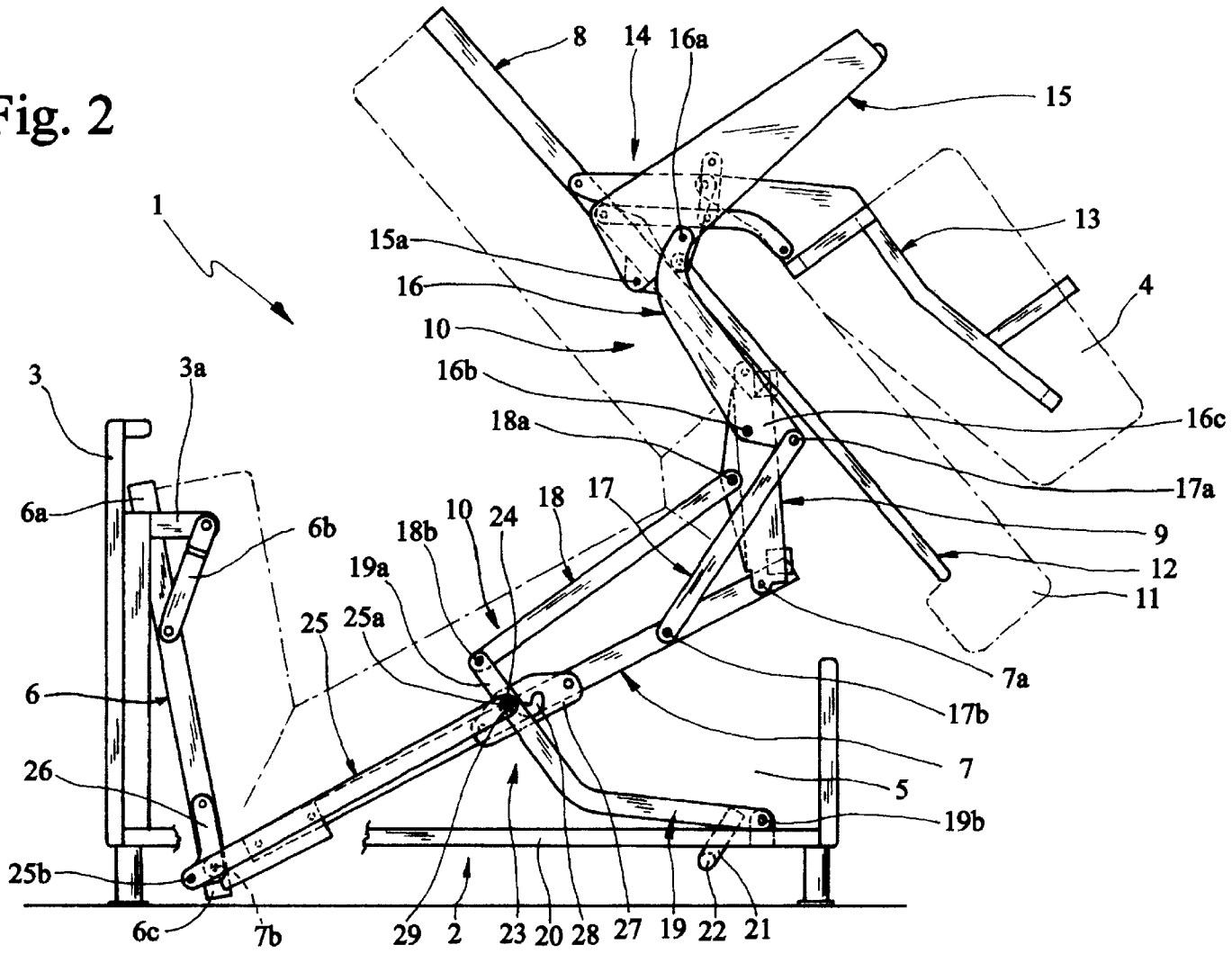
FIGS. 2 and 3 are side views in which the sofa-bed is shown in intermediate successive configurations between the sofa condition and bed condition.
Figure 3:
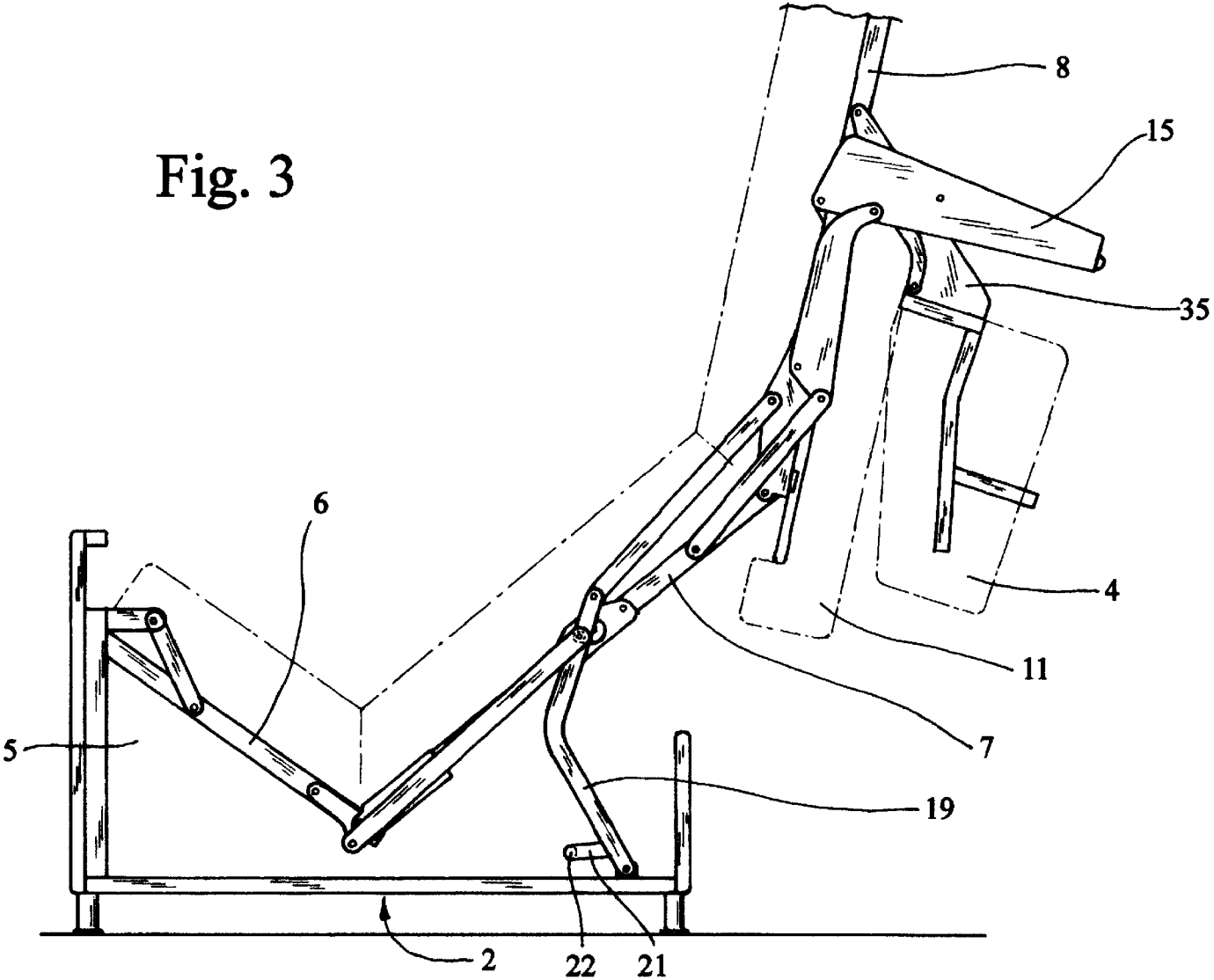

With reference to the drawings, the sofa-bed in accordance with the invention is generally identified by reference numeral 1.

It conventionally comprises a fixed carrying structure 2 consisting of a metal framework having a substantially parallelepiped configuration and in turn comprising several frames among which there is at least one rear vertical frame 3 which in a sofa configuration is intended for being adjacent to a vertical set of cushions forming the sofa back 4.

The fixed carrying structure 2 internally defines a housing space 5 within which three or more main movable frames folded over upon each other in a closed position are disposed when the sofa bed is in the configuration of a sofa as shown in FIG. 1; said movable frames, and more particularly one first frame 6, one second frame 7, one third frame 8 and one fourth intermediate frame 9 are rotatably and consecutively in engagement with each other.

Figure 4:
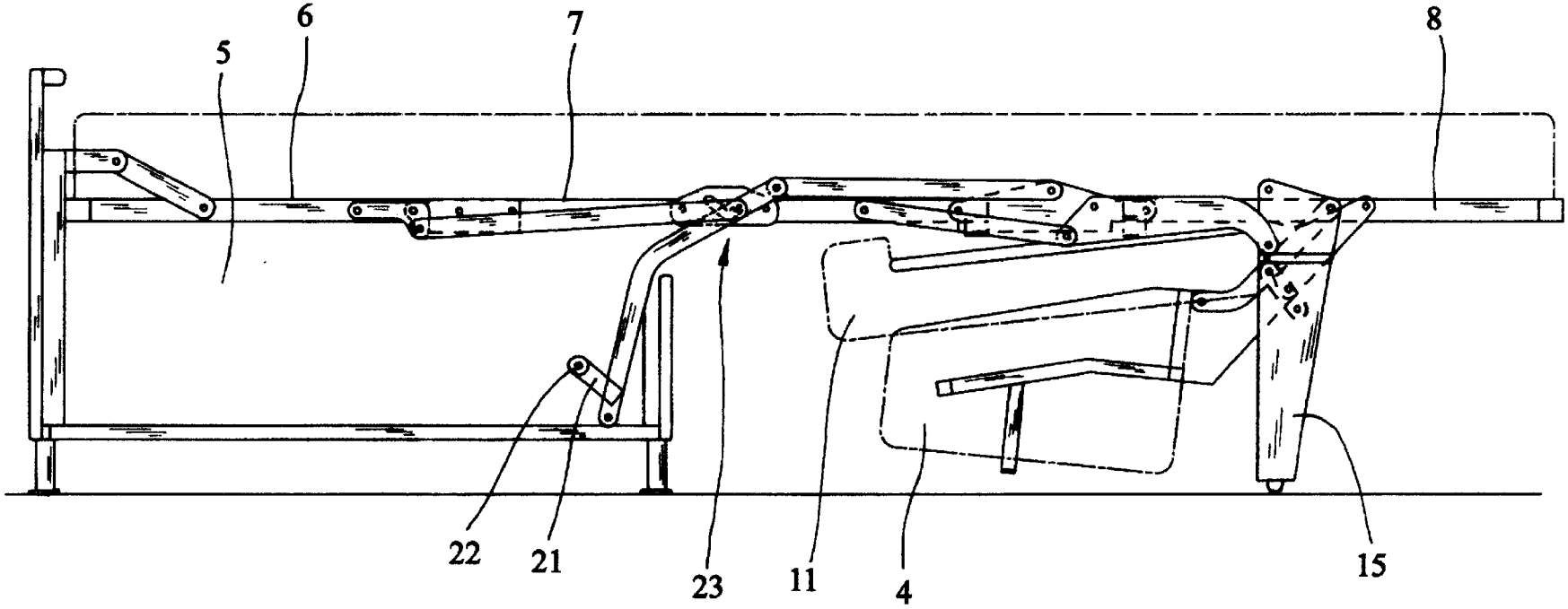
FIG. 4 is a side view of the sofa-bed in a bed condition, i.e. a condition in which all movable frames are extend in a horizontal direction.
Figure 8:
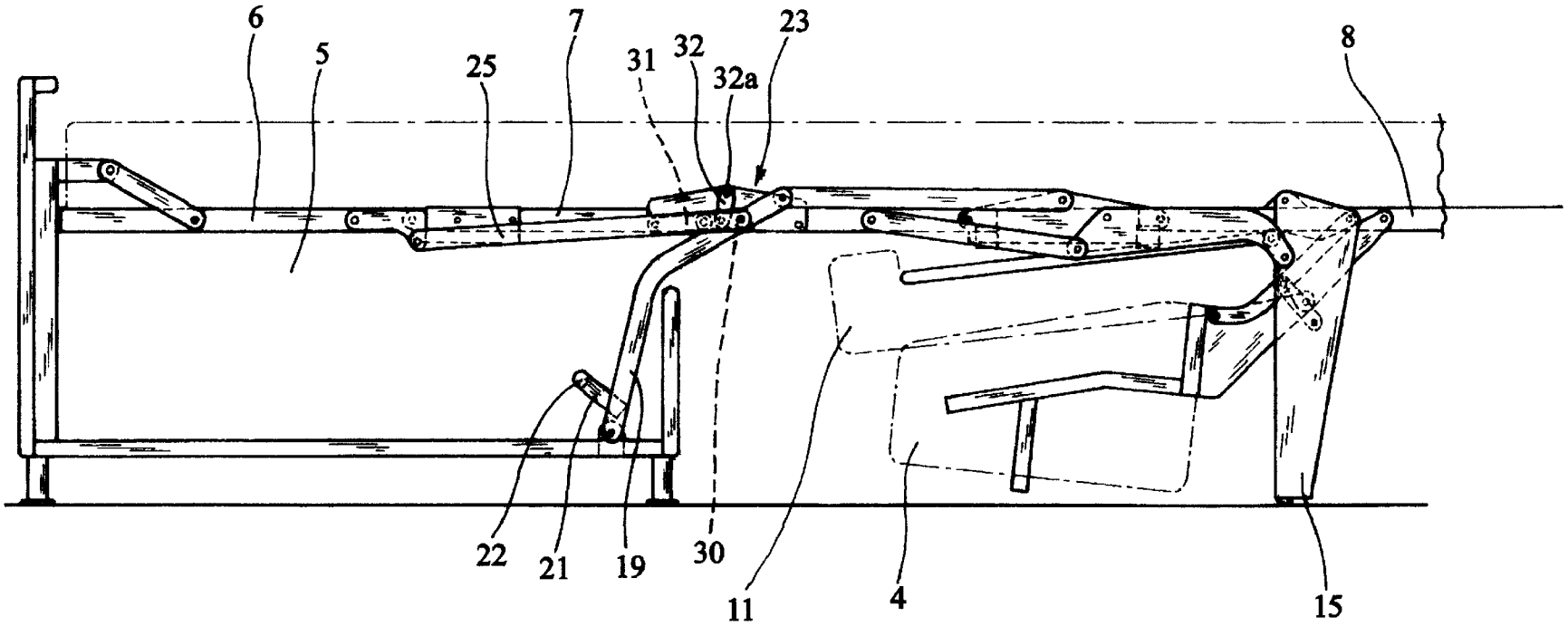

Said movable frames are shiftable from said closed position to an open position, in which they are consecutively aligned with each other externally of the housing space 5, to define a resting plane (shown in FIGS. 4 and 8). This movement is achieved by means of an original kinematic driving mechanism generally denoted by 10 and comprising synchronization means interposed between the movable frames and adapted to move the latter by a single operation or work step from the closed position to the open position and vice versa.

The first movable frame 6 is rotatably connected, close to a first end 6*a* thereof, to the fixed vertical frame 3 by interposition, for each side of the sofa-bed, of a link 6*b* integral with the first frame 6 itself and a tongue 3*a* integral with the vertical frame 3.

The second movable frame 7 in a sofa condition is disposed horizontally on the bottom of the housing space 5, whereas the third movable frame 8 in this condition substantially supports a horizontal set of cushions 11.

Also provided is a first auxiliary frame 12 with which the horizontal set of cushions 11 is associated and a second conveniently-shaped auxiliary frame 13 adapted to engage and support the vertical set of cushions 4.

In an original manner, the kinematic driving mechanism 10 comprises an auxiliary leverage 14 operatively interposed between the third movable frame 8 and the auxiliary frames 12 and 13. The auxiliary leverage is capable of moving the auxiliary frames 12 and 13 themselves (and consequently the respective horizontal and vertical sets of cushions 11 and 4) in synchronism with the displacements of all movable frames, between an operating position corresponding to a sofa configuration, in which this set of cushions is substantially disposed upon the third movable frame (see FIG. 1) and a rest position, corresponding to a bed configuration, in which the horizontal set of cushions is disposed below the resting plane and the vertical set of cushions 4 is brought parallelly to and below the horizontal set of cushions.

In more detail, the kinematic driving mechanism 10 interposed between the different main movable frames, for each side of the sofa-bed comprises a first lever 15 forming a resting foot, articulated, at a pivot point 15*a*, on a central area of the third movable frame 8. The first lever 15 can be overturned from an initial position in which, the sofa bed being in a sofa configuration, said lever 15 is substantially parallel to the third movable frame 8 to a final position already reached at the beginning of the opening operation in which said lever 15 is substantially perpendicular to the third frame 8.

A second substantially J-shaped lever 16 is rotatably associated with the first lever 15 at a curved end 16*a* of said "J" and has a second pivot point 16*b* at an intermediate area of the intermediate movable frame 9, close to a first angle of an end portion 16*c* of lever 16 which is slightly extended and opposed to the curved end 16*a*.

A third lever 17 is articulated, at a first end 17*a* thereof, on a second angle of the end portion 16*c* of the second lever 16 and, at a second end 17*b* thereof, on an area of the second movable frame 7 close to the pivot point 7*a* of said movable frame 7 on the intermediate movable frame 9.

Practically, the second lever 16, by exerting pressure on the second pivot point 16*b*, enables the third movable frame 8 and intermediate frame 9 to be opened or closed together and, by acting on the first end 17*a* of the third lever 17, forces the latter to open or close the second frame 7 with respect to the intermediate frame 9.

A fourth lever 18 is articulated, at a first end thereof, on a central area of the intermediate frame 9 and at a second end thereof 18*b* on a first end 19*a* of a fifth lever 19 bent at an obtuse angle. The fifth lever 19 has a second end 19*b* articulated on a fixed bottom frame 20 of the carrying structure 2 and, by interposition of a rectilinear end piece 21, supports a horizontal bar 22 adapted to define a support element for the second movable frame 7 and therefore also for the other movable frames when they are folded over in a sofa configuration.

Interposed between the fifth lever 19 and an intermediate area of the second movable frame 7 there is a connecting and locking means 23 adapted to define between the second movable frame 7 and the fifth lever 19, a pivot point 24 movable along a trajectory having a locking point corresponding to alignment between the first movable frame 6 and the second movable frame 7, in a bed configuration. Practically the connecting and locking means 23 is adapted to counteract a closing action on the movable frames disposed in alignment, exerted by loads acting at an area close to a pivot point 7*b* between said first and second movable frames.

Displacement of the pivot point 24 along its trajectory is imposed by a sixth driving lever 25 having one end 25*a* articulated on an intermediate point of the fifth lever 19 defining the movable pivot point 24 and a second end 25*b* articulated on an L-shaped end piece 26 integral with the first movable frame 6 at a second end 6*c* of said movable frame itself.

In a first embodiment, shown in FIGS. 1–4, the connecting and locking means 23 comprises a guide body 27 integral with the second frame 7 and having an oblong substantially L-shaped hole defining said trajectory. Rotatably associated with the intermediate point 24 of the fifth lever 19 defining said movable pivot point is a rolling element 29 which is therefore also rotatably associated with the first end 25*a* of the sixth lever 25. The rolling element 29 is slidably housed within the oblong hole 28. The sixth lever 25 imposes displacement of the rolling element 29 to the locking point of the oblong hole 28 which practically defines an undercut when the second frame 7 is in alignment, in the bed configuration, with the first movable frame 6 (see FIG. 4).

Figure 7:
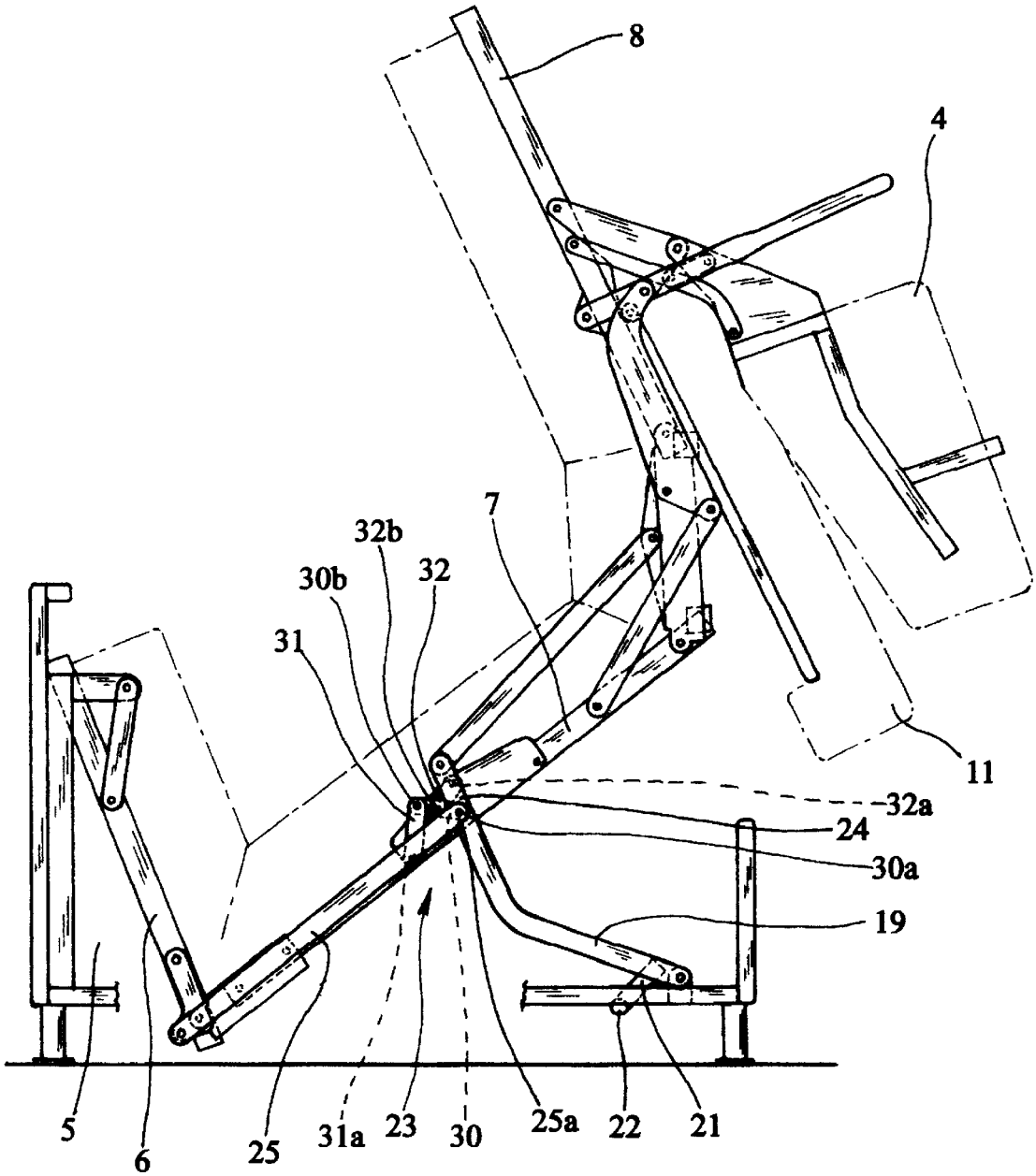
FIGS. 7 and 8 are views similar to FIGS. 2 and 4 respectively, and relate to an alternative embodiment of connecting means being part of the kinematic driving mechanism of the sofa-bed.

In a second embodiment, shown in FIGS. 7 and 8, the connecting and locking means 23 comprises: a first small lever 30 having one end 30*a* articulated on the first end 25*a* of the sixth lever 25 and on the intermediate point 24 of the fifth lever 19 defining said movable pivot point; a second small lever 31 articulated, at one end 31*a* thereof, on the second movable frame 7 and at a second end thereof, on a second end 30*b* of the first small lever 30; and a third small lever 32 articulated, at a first end 32*a* thereof, on the second movable frame 7 and at a second end 32*b* thereof on an intermediate point of the first small lever 30.

Figure 5:
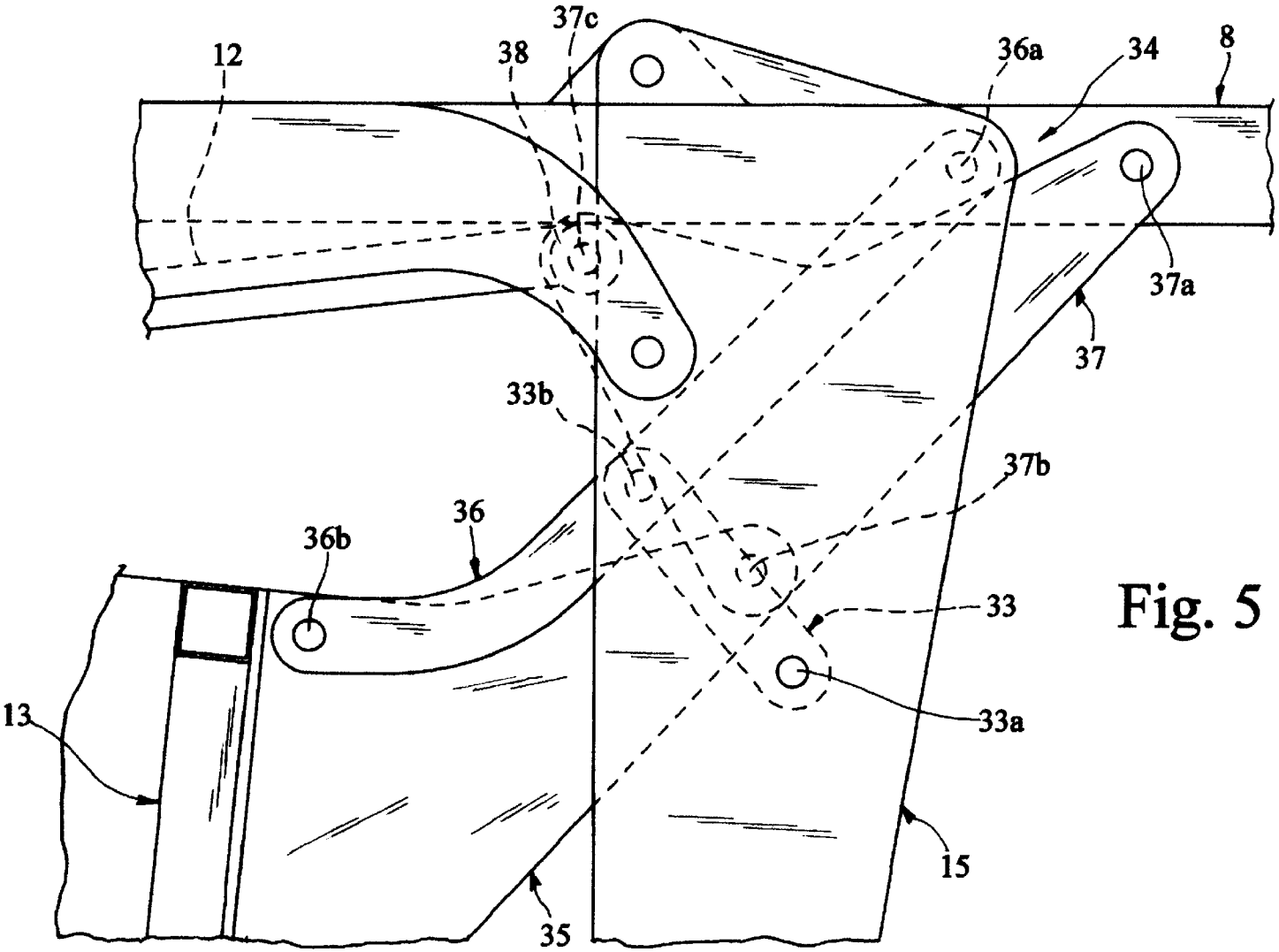
FIG. 5 is an enlarged view of an auxiliary driving leverage for the horizontal and vertical sets of cushions.
Figure 6:
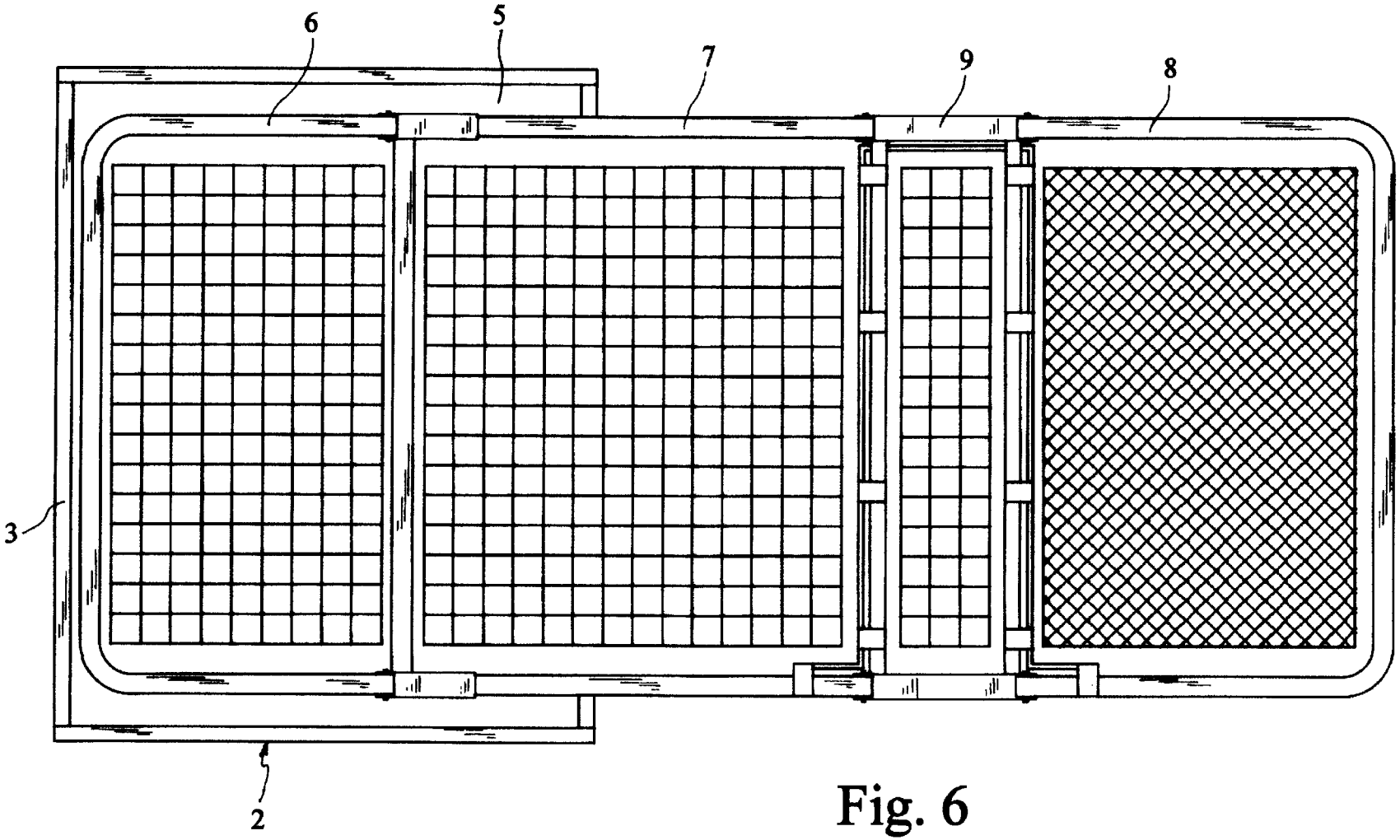

The auxiliary leverage 14, shown to an enlarged scale in FIG. 5, comprises means for moving the horizontal set of cushions 11 in a reciprocating motion substantially parallel to the third movable frame 8 and in synchronism with the overturning of the first foot lever 15. This movement means practically prevents the first lever 15 from interfering with the horizontal set of cushions, when said lever 15 is perpendicular to the third movable frame 8. Therefore said horizontal set of cushions can keep its perimetric conformation, which means that within its shape no stress-relieving notches or hollows capable of housing the first levers 15 need to be formed.

More particularly, the auxiliary leverage 14 comprises a small driving lever 33 articulated, at one end thereof 33*a*, on the first lever 15 and adapted to move a four-bar linkage 34 closed on the third movable frame 8. In more detail, the four-bar linkage 34 in turn comprises a connecting rod 35 defined by a plate integral with the bottom of the second auxiliary frame 13 with which the vertical set of cushions 4 is associated; a first crank 36 defined by a curved lever articulated at one end 36*a* thereof on the third movable frame 8 and at a second end 36*b* thereof on a first pivot point of the connecting rod 35; a second crank 37 defined by a shaped plate substantially in the form of a triangle and articulated, at a first vertex 37*a* thereof, on the third movable frame 8 and, at a second vertex 37*b* thereof, on a second pivot point of the connecting rod 35.

The second crank 37 has a third expansion corresponding to a third vertex 37*c* rotatably connected to a tubular element 38 in turn integral with a rear portion, in a sofa configuration, of the first auxiliary frame 12 with which the horizontal set of cushions is associated.

Practically, crank 37 by its rotation about the first vertex 37*a* defines said movement means allowing the horizontal set of cushions 11 to be moved between a first position located backward of the third movable frame 8 and an advanced position in which the set of cushions projects from said third movable frame, corresponding to overturning of the first lever 15 to a position transverse to said third frame.

Finally, the driving small lever 33 has a second end 33*b* articulated on an intermediate point of the first crank 36, so as to synchronize the crank rotation, and therefore the movement of one complete four-bar linkage 34, with the rotation of the first lever 15 and the other levers forming the kinematic driving mechanism 10.

The particular kinematic connection obtained by the auxiliary leverage 14 and more generally by the whole kinematic driving mechanism 10 is only a preferential solution. That which is instead essential is the presence of a kinematic driving mechanism capable of synchronizing the opening and closing movement of the main movable frames with the movement of the horizontal and vertical sets of cushions.

Operation of a sofa-bed described above mainly as regards structure is as follows.

For unfolding of the movable frames in order to pass from the closed condition (see FIG. 1) to the open condition (see FIGS. 4 and 8), it is necessary for the user to act on the vertical set of cushions by drawing it forward and lowering it until it matches with, and abuts against the horizontal set of cushions. The opening action goes on smoothly without interruptions until the complete alignment of the movable frames in a rest position and until overturning through 180° and through 270° has been accomplished by the horizontal set of cushions and the vertical set of cushions, respectively.

In the same manner, to bring the sofa-bed back to the sofa condition, the user, by acting on the end of the third movable frame 8 or the first foot lever 15 can close all the movable frames and bring them back to the position within the housing space 5 by a single operation.

Simultaneously, the auxiliary leverage 14 brings the horizontal set of cushions to a backward position and the vertical set of cushions transversely of the former in their use position.

The invention achieves important advantages.

First of all the connections established between the different movable frames and auxiliary frames by the kinematic driving mechanism and in particular the auxiliary leverage enable a complete, easy and smooth movement of all frames by a single operation.

Due to the synchronized movement of the horizontal and vertical sets of cushions, not only additional tiresome operations for removing said sets of cushions when the sofa-bed is to be used as a bed are avoided, but also the vertical set of cushions does not occupy the forward space with respect to the bottom frame of the fixed carrying structure and therefore this space can be fully exploited over the whole depth thereof in a horizontal direction, since the head of the resting plane can be moved close to said bottom frame.

I claim:

1. The sofa-bed comprising a fixed carrying structure (2) internally defining at least one housing space (5) and comprising at least one rear vertical frame (3) disposed externally of a set of vertically-extending cushions forming the sofa back (4), at least three main movable frames (6, 7, 8) consecutively and rotatably in engagement with each other, said movable frames being shiftable in a rotatory-translator movement between a closed position, in which they are folded upon each other and substantially disposed within said housing space (5), and an open or unfolded position in which the movable frames are consecutively aligned with each other at the outside of said housing space to define a resting plane, a kinematic driving mechanism (10) operatively interposed at least between each movable frame and the consecutive one of said movable frames, said kinematic driving mechanism being adapted to move at least all said movable frames by a single operation from the closed position to the open position and vice versa, at least one first auxiliary frame (12) with which a horizontal set of cushions (11) is associated and at least one second auxiliary frame (13) with which a vertical set of cushions forming the sofa back (4) of said sofa-bed is associated, said kinematic driving mechanism has at least one auxiliary leverage (14) operatively interposed between said auxiliary frames (12, 13) and at least one of said main movable frames (6, 7, 8) to move the horizontal and vertical sets of cushions (11 and 4) from an operating position corresponding to a sofa conformation, in which said sets of cushions are substantially disposed on top of the movable frames folded upon each other in a closed position, and a rest position corresponding to a bed configuration in which the horizontal set of cushions is brought below said resting plane and the vertical set of cushions is disposed parallel to and below the horizontal set of cushions, a first one (6) of said main movable frames is rotatably connected, close to one end (Ga) thereof, to said rear vertical frame (3) of the fixed carrying structure (2), and in that said auxiliary leverage (14) is connected to a third one (8) of said main movable frames, said third movable frame (8) being engaged consecutively of a second one (7) of said movable frames upon interposition of an intermediate movable connecting frame (9), said horizontal set of cushions (11) being substantially supported, when the sofa-bed is in a sofa configuration, by said third movable frame, said kinematic driving mechanism (10) having:

a first lever forming a resting foot (15), 25 articulated on a centre area of said movable frame (8) and adapted to be overturned between an initial position, the sofa-bed being in a sofa configuration, in which said first lever (15) is substantially parallel to the third movable frame (8), and a final position in which it is substantially perpendicular to the third movable frame (8);

a substantially J-shaped second lever (16) rotatably connected with said first lever (15) at the curved end (16*a*) of said "J", and with an intermediate area of said intermediate frame (9) at a first angle of an end portion (16*c*) opposed to said curved end, a third lever (17) articulated, at a first end (17*a*) thereof, on a second angle of the end portion (1Cc) of said second J-shaped lever (16) and, at a second end thereof (17*b*), on an area of the second movable frame (7) close to the pivot point of said second frame (7) on said intermediate frame (9), a fourth lever (18) articulated, at a first end 10 thereof (18*a*), on a centre area of said intermediate movable frame (9), a fifth lever (19) bent at an obtuse angle and articulated at a first end thereof (19*a*)

on a second end (18*b*) of said fourth lever, said fifth lever having a second end (19*b*) articulated on a fixed bottom frame (20) of said fixed structure (2), connecting and locking means (23) between said fifth lever and an intermediate area of said second movable frame (7), adapted to define a pivot point (24) between said fifth lever and the second frame itself, which pivot point (24) is movable along a trajectory having at least one locking point corresponding to alignment of the first and second movable frames in said bed configuration, said connecting means being adapted to counteract the closing action of loads acting on an area close to the pivot point between said first and second frames (6 and 7); and a sixth driving lever (25) for said connecting means, for moving said pivot point (24) along said trajectory, said sixth lever having one end (25*a*) articulated on an intermediate point of said fifth lever (19) defining said movable pivot point (24) and a second end (25*b*) articulated on an L-shaped tailpiece (26) integral with said first movable frame at a second end (6*c*) of said first frame.

2. The sofa-bed as claimed in claim 1, wherein said connecting and locking means (23) comprises:

a guide body (27) integral with the second movable frame (7) and having a substantially L-shaped oblong hole (28) defining said trajectory, and a rolling element (29) rotatably connected with said fifth lever (19) at said intermediate point and with said first end (25*a*) of said sixth lever (25), said rolling element (29) being slidably housed in said L-shaped oblong hole (28).

3. The sofa-bed as claimed in claim 1, wherein said connecting and locking means (23) comprises:

a first small lever (30) having a first end (30*a*) articulated on said first end (25*a*) of said sixth lever (25) and on said intermediate point (24) of said fifth lever (19);

a second small lever (31) articulated at a first end (31*a*) thereof, on said second frame (7) and at a second end (31*b*) thereof, on a second end (30*b*) of said first small lever (30), and a third small lever (32) articulated at a first end (32*a*) thereof on said second movable frame (7) and at a second end (32*b*) thereof on an intermediate point of said first small lever (30).

4. The sofa-bed as claimed in claim 1, wherein said auxiliary leverage (14) comprises movement means for moving the horizontal set of cushions (11) in an alternating motion substantially parallel to said third movable frame (8) and synchronized with the overturning of said first foot lever (15) so that said foot lever does not interfere with the horizontal set of cushions (11) when it is disposed in said final position substantially perpendicular to the third movable frame (8).

5. The sofa-bed as claimed in claim 1, wherein said auxiliary leverage (14) comprises:

a small driving lever (33) having one end (33*a*) articulated on said first foot lever (15), a four-bar linkage (34) closed on said third movable frame (8) and moved by said small driving lever (33), said four-bar linkage comprising:

a connecting rod (35) defined by a plate integral with the bottom of said second auxiliary frame with which the vertical set of cushions is associated;

a first crank (36) defined by a curved lever and articulated at a first end (36*a*) thereof on said third movable frame and at a second end (36*b*) thereof on a first pivot point of said connecting rod, said first crank being rotatably connected, at an intermediate point thereof, with a second end of said driving small lever, and a second crank (37) defined by a plate substantially in the form of a triangle and articulated close to a first vertex (37*a*) thereof, on the third movable frame (8), and at a second vertex (37*b*) thereof on a second pivot point of said connecting rod (35), said second crank being rotatably connected, close to the third one (37*c*) of its vertices, with a rear portion, when the sofa-bed is in a sofa configuration, of said first auxiliary frame (12) with which the horizontal set of cushions (11) is associated, and defining said movement means for said horizontal set of cushions.

6. A sofa bed of the type comprising:

a fixed carrying structure (2) internally defining at least one housing space (5) and having at least one rear vertical frame (3) disposed externally of a set of vertically extending cushions forming the sofa back (4), at least three main movable frames (6,7,8) consecutively and rotatably in engagement with each other, said movable frames being shiftable in a rotatory-translatory movement between a closed position, in which they are folded upon each other and substantially disposed within said housing space (5), and an open position, in which the movable frames are consecutively aligned with each other at the outside of said housing space to define a resting plane, at least one first auxiliary frame (12) with which a horizontal set of cushions (11) is associated, at least one second auxiliary frame (13) with which a vertical set of cushions forming the sofa back (4) of said sofa bed is associated, a kinematic driving mechanism (10) operatively interposed at least between each movable frame and the consecutive one of said movable frames, and presenting a first lever forming a resting foot (15) operatively engaged to said movable frame (8) and adapted to be overturned between an initial position, where the sofa bed is in a sofa configuration, in which said first lever is substantially parallel to the movable frame (8), and a final position in which it is substantially perpendicular to the movable frame (8), said kinematic driving mechanism being adapted to move at least all said movable frames by a single operation, from the closed position to the open position and vice versa and adapted to obtain an opening action going on smoothly without interruptions until the complete alignment of the movable frames (6, 7, 8) in the open position and vice versa, at least one auxiliary leverage (14) operatively interposed between said auxiliary frames (12, 13) and at least one of said main movable frames (6, 7, 8) to move the horizontal and vertical sets of cushions (11, 4) from an operating position corresponding to a sofa conformation, in which said sets of cushions are substantially disposed on top of the movable frames folded upon each other in the closed position, and a rest position, corresponding to a bed configuration, in which the horizontal set of cushions is brought below said resting plane and the vertical set of cushions is disposed parallel to and below the horizontal set of cushions, said at least one auxiliary leverage (14) presenting movement means (37) for moving the horizontal set of cushions (11) in an alternating motion substantially parallel to said movable frame (8) and synchronized with the overturning of said resting foot (15) so that said resting foot does not interfere with the horizontal set of cushions (11) when it is disposed in said final position substantially perpendicular to the movable frame (8).

7. The sofa-bed as claimed in claim 6, wherein a first one (6) of said main movable frames is rotatably connected, close to one end **(6*a*) thereof, to said rear vertical frame (3) of the fixed carrying structure (2), and in that said auxiliary leverage (14) is connected to a third one (8) of said main movable frames, said third movable frame (8) being engaged consecutively of a second one (7) of said movable frames upon interposition of an intermediate movable connecting frame (9), and said horizontal set of cushions (11)** being substantially supported, when the sofa-bed is in a sofa configuration, by said third movable frame.

8. The sofa bed as claimed in claim 6, wherein said kinematic driving mechanism (10) comprises, for each bed side:

a substantially J-shaped second lever (16) rotatably connected with said first lever (15) at the curved end **(16*a*) of said "J", and with an intermediate area of said intermediate frame (9) at a first angle of an end portion (16*c*)** opposed to said curved end;

a third lever (17) articulated, at a first end **(17*a*) thereof, on a second angle of the end portion (1Cc) of said second J-shaped lever (16) and, at a second end thereof (17*b*), on an area of the second movable frame (7) close to the pivot point of said second frame (7) on said intermediate frame (9)**;

a fourth lever (18) articulated, at a first end thereof **(18*a*), on a centre area of said intermediate movable frame (9), a fifth lever (19) bent at an obtuse angle and articulated at a first end thereof (19*a*) on a second end (18*b*) of said fourth lever, said fifth lever having a second end (19*b*) articulated on a fixed bottom frame (20) of said fixed structure (2)**;

connecting and locking means (23) between said fifth lever and an intermediate area of said second movable frame (7), adapted to define a pivot point (24) between said fifth lever and the second frame itself, which pivot point (24) is movable along a trajectory having at least one locking point corresponding to alignment of the first and second movable frames in said bed configuration, said connecting means being adapted to counteract the closing action of loads acting on an area close to the pivot point between said first and second frames (6 and 7); and a sixth driving lever (25) for said connecting means, for moving said pivot point (24) along said trajectory, said sixth lever having one end **(25*a*) articulated on an intermediate point of said fifth lever (19) defining said movable pivot point (24) and a second end (25*b*) articulated on an L-shaped tailpiece (26) integral with said first movable frame at a second end (6*c*)** of said first frame.

9. The sofa-bed as claimed in claim 8, wherein said connecting and locking means (23) comprises:

a guide body (27) integral with the second movable frame (7) and having a substantially L-shaped oblong hole (28) defining said trajectory, and a rolling element (29) rotatably connected with said fifth lever (19) at said intermediate point and with said first end **(25*a*) of said sixth lever (25), said rolling element (29) being slidably housed in said L-shaped oblong hole (28)**.

10. The sofa-bed as claimed in claim 8, wherein said connecting and locking means (23) comprises:

a first small lever (30) having a first end **(30*a*) articulated on said first end (25*a*) of said sixth lever (25) and on said intermediate point (24) of said fifth lever (19)**;

a second small lever (31) articulated at a first end **(31*a*) thereof, on said second frame (7) and at a second end (31*b*) thereof, on a second end (30*b*) of said first small lever (30), and a third small lever (32) articulated at a first end (32*a*) thereof on said second movable frame (7) and at a second end (32*b*) thereof on an intermediate point of said first small lever (30)**.

11. The sofa-bed as claimed in claim 6, wherein said auxiliary leverage (14) comprises:

a small driving lever (33) having one end **(33*a*) articulated on said first foot lever (15), a four-bar linkage (34) closed on said third movable frame (8) and moved by said small driving lever (33)**, said four-bar linkage comprising:

a connecting rod (35) defined by a plate integral with the bottom of said second auxiliary frame with which the vertical set of cushions is associated;

a first crank (36) defined by a curved lever and articulated at a first end (3Ca) thereof on said third movable frame and at a second end (3Gb) thereof on a first pivot point of said connecting rod, said first crank being rotatably connected, at an intermediate point thereof, with a second end of said driving small lever, and a second crank (37) defined by a plate substantially in the form of a triangle and articulated close to a first vertex **(37*a*) thereof, on the third movable frame (8), and at a second vertex (37*b*) thereof on a second pivot point of said connecting rod (35), said second crank being rotatably connected, close to the third one (37*c*) of its vertices, with a rear portion, when the sofa-bed is in a sofa configuration, of said first auxiliary frame (12) with which the horizontal set of cushions (11)** is associated, and defining said movement means for said horizontal set of cushions.

* * * * *